US009364077B2

(12) United States Patent
Werner

(10) Patent No.: US 9,364,077 B2
(45) Date of Patent: Jun. 14, 2016

(54) PORTABLE FURNITURE

(71) Applicant: Thomas J. Werner, Portland, OR (US)

(72) Inventor: Thomas J. Werner, Portland, OR (US)

( * ) Notice: Subject to any disclaimer, the term of this patent is extended or adjusted under 35 U.S.C. 154(b) by 0 days.

(21) Appl. No.: 14/553,057

(22) Filed: Nov. 25, 2014

(65) Prior Publication Data

US 2015/0076871 A1 Mar. 19, 2015

Related U.S. Application Data

(60) Provisional application No. 61/909,248, filed on Nov. 26, 2013.

(51) Int. Cl.

| | |
|---|---|
| ***A47B 3/06*** | (2006.01) |
| ***A47C 4/02*** | (2006.01) |
| ***A47C 7/50*** | (2006.01) |
| ***A47C 9/10*** | (2006.01) |
| ***A47B 3/12*** | (2006.01) |

(52) U.S. Cl.

CPC ... *A47B 3/06* (2013.01); *A47B 3/12* (2013.01); *A47C 4/021* (2013.01); *A47C 7/50* (2013.01); *A47C 9/10* (2013.01)

(58) Field of Classification Search

CPC ..... A47B 13/08; A47B 3/06; A47C 4/021; A47C 7/50; A47C 4/02; A47C 13/005; A47C 7/42; A47C 7/543

USPC ..... 297/135, 440.1, 423.1, 440.13, 440.14, 297/188.08, 461, 440.22, 16.1, 16.2, 297/188.12, 188.09; 108/159, 101, 157.16, 108/13, 14, 25, 26, 26.2, 153.1, 157.1, 108/157.18, 158.12, 118, 131, 119, 115, 108/180, 186

See application file for complete search history.

(56) References Cited

U.S. PATENT DOCUMENTS

| | | | | | |
|---|---|---|---|---|---|
| 237,488 | A | * | 2/1881 | Conway | A47B 11/00 108/14 |
| 401,798 | A | * | 4/1889 | Spencer | A63G 11/00 297/440.13 |
| 518,581 | A | * | 4/1894 | Bartlett | A47B 11/00 108/14 |
| 1,039,134 | A | * | 9/1912 | Jenkins | A47B 11/00 108/139 |
| 1,940,117 | A | * | 12/1933 | Carpos | A47B 3/06 108/157.18 |
| 2,107,178 | A | * | 2/1938 | Fackler | A47F 7/06 211/33 |
| 2,235,290 | A | * | 3/1941 | Exline | A47B 3/06 108/159 |
| 2,347,821 | A | * | 5/1944 | Goldner | A47C 4/021 108/159 |
| 2,444,991 | A | * | 7/1948 | Hunter | A47C 4/021 297/440.13 |
| 2,456,111 | A | * | 12/1948 | Creech | A47D 3/005 297/136 |

(Continued)

FOREIGN PATENT DOCUMENTS

| | | | | | |
|---|---|---|---|---|---|
| GB | 2151473 | A | * | 7/1985 | A47C 4/021 |
| IL | GB 2264229 | A | * | 8/1993 | A47C 4/02 |

*Primary Examiner* — Beth Stephan

(74) *Attorney, Agent, or Firm* — Mohr Intellectual Property Law Solutions, PC

(57) ABSTRACT

Portable furniture items including a support structure and a top member selectively coupled to the support structure. The support structure includes first and second supports. The first support includes a leg having a ground end and a waist extending from the leg opposite the ground end. The waist has an upper end opposite the ground end and defines a first notch proximate the upper end. The second support includes a leg having a ground end and a waist extending from the leg opposite the ground end. The waist of the second support has an upper end opposite the ground end and a lower end opposite the upper end and defines a second notch proximate the lower end. The first notch and the second notch are complimentarily configured to enable the second support to matingly couple with the first support.

20 Claims, 6 Drawing Sheets

(56) References Cited

U.S. PATENT DOCUMENTS 2,456,964 A * 12/1948 Ledure ..... A47F 7/06 108/115
2,628,668 A * 2/1953 Basile ..... A47C 4/021 108/159
2,640,527 A * 6/1953 Kreizelman ..... A47C 4/02 248/188
3,338,189 A * 8/1967 Xavier ..... A47C 4/021 108/159
3,396,933 A * 8/1968 Ward ..... A47B 13/04 108/118
3,407,001 A * 10/1968 Minsker ..... A47C 4/021 297/440.13
4,089,560 A * 5/1978 de Mattos ..... A47C 4/03 297/440.11
4,825,781 A * 5/1989 Palmer ..... A47B 3/06 108/115
4,846,353 A * 7/1989 Knight ..... B25H 1/0014 211/189
5,644,995 A * 7/1997 Gurwell ..... A47B 3/12 108/158.12
6,205,936 B1 * 3/2001 Nelson ..... A47C 4/021 108/157.1
D472,396 S * 4/2003 de Blois ..... A47B 13/08 D6/349
6,848,747 B1 * 2/2005 Robinson ..... A47C 4/021 297/440.1
7,631,605 B2 * 12/2009 Willy ..... A47B 13/003 108/157.16
8,020,497 B2 * 9/2011 Ossorguine ..... A47B 7/02 108/157.14
8,225,726 B1 * 7/2012 Fineberg ..... A47B 3/06 108/115
8,303,041 B2 * 11/2012 Gasser ..... A47B 13/02 248/163.1
2003/0041786 A1 * 3/2003 Arnell ..... A47B 25/00 108/11
2003/0107254 A1 * 6/2003 Willy ..... A47B 3/06 297/440.13
2008/0245281 A1 * 10/2008 Willy ..... A47B 13/003 108/157.16
2010/0276971 A1 * 11/2010 Maxwell ..... A47C 4/028 297/183.1
2012/0111241 A1 * 5/2012 Karp ..... A47B 13/08 108/157.17

* cited by examiner

PORTABLE FURNITURE

CROSS REFERENCE TO RELATED APPLICATIONS

This application claims priority to copending U.S. Provisional Patent Application, Ser. No. 61,909,248, filed on Nov. 26, 2013, which is hereby incorporated by reference for all purposes.

BACKGROUND

The present disclosure relates generally to portable furniture. In particular, portable furniture configured to be easily assembled and disassembled are described.

Many events, such as trade shows, conventions, receptions, and other large gatherings, require large amounts of seating and table space. Often, these events are hosted at venues that use portable furniture to satisfy this need. In many cases, hosting an event requires transporting and setting up hundreds of portable seats and tables to prepare for the event. When unused, this portable furniture is often transported to a remote storage facility and stored until needed again. There exists a need for portable furniture that improves on existing portable furniture solutions by being easier to set up, disassemble, and store.

Furniture often falls within one of three categories: foldable or stackable furniture; flat pack or kit furniture; or fixed furniture. Furniture in each of these categories are most often inefficient to store, difficult to transport, difficult to set up, and inconvenient to remove from events.

Fixed furniture is generally non-adjustable and purchased in a fixed form. Fixed furniture is designed to remain in that fixed form for its useful life. Because fixture furniture is not designed to be readily assembled and disassembled, it is ineffective as a portable furniture solution.

Flat pack or kit furniture is designed for users to assemble prior to use. Many examples of flat pack or kit furniture items are sold by IKEA®. While these items are efficient to store prior to assembly, they are not designed to be disassembled or adjusted for transport once assembled. Accordingly, flat pack and kit furniture lacks the portability and efficient storage capabilities required of an effective temporary or portable furniture solution.

Foldable and stackable furniture, while being designed for portability, is hampered by design limitations that hinder its effectiveness as a portable furniture solution. For example, foldable and stackable furniture is not typically configured to be disassembled, and thus fails to maximize storage and transport efficiency when not being used.

Further, many current examples of temporary furniture employ a Spartan, utilitarian design. Accordingly, known temporary furniture examples are generally considered drab, unexciting, unappealing, and unsuitable for hosted venues. As a result, there exists a need for furniture that is portable while also aesthetically pleasing.

Many conventional portable furniture items have limited strength, rigidity, and stability. There exists a need for portable furniture items with improved strength, rigidity, and stability.

Thus, there exists a need for portable furniture that improve upon and advance the design of known portable furniture options. Examples of new and useful portable furniture items relevant to the needs existing in the field are discussed below.

SUMMARY

The present disclosure is directed to portable furniture items including a support structure and a top member selectively coupled to the support structure. The support structure includes first and second supports. The first support includes a leg having a ground end and a waist extending from the leg opposite the ground end. The waist has an upper end opposite the ground end and defines a first notch proximate the upper end. The second support includes a leg having a ground end and a waist extending from the leg opposite the ground end. The waist of the second support has an upper end opposite the ground end and a lower end opposite the upper end and defines a second notch proximate the lower end. The first notch and the second notch are complimentarily configured to enable the second support to matingly couple with the first support.

DETAILED DESCRIPTION

Figure 1:
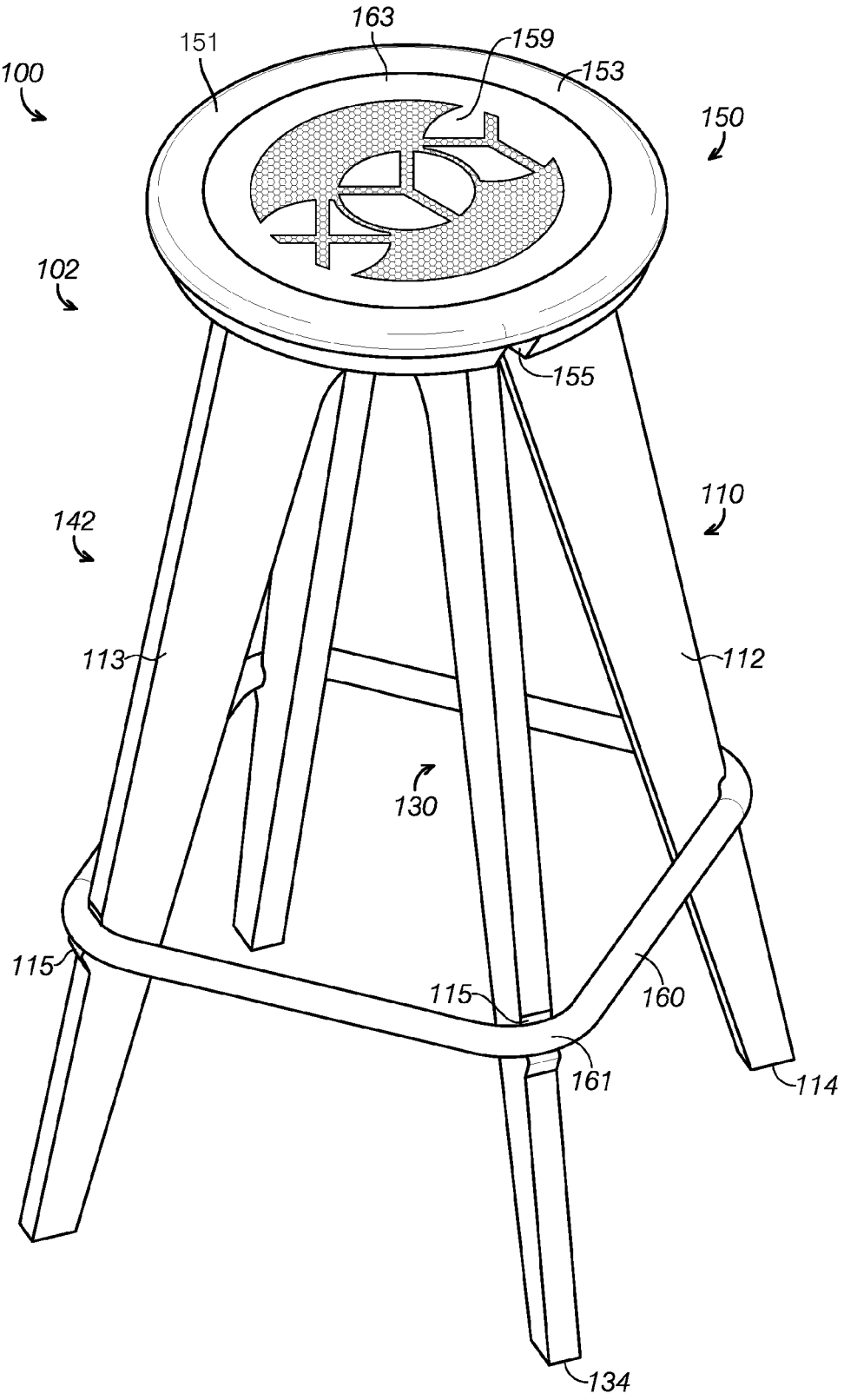
FIG. 1 is a perspective view of a first example of a portable furniture item in the form of a stool.

The disclosed portable furniture items will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various portable furniture items are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-5, a first example of a portable furniture item, portable furniture item 100, will now be described. As can be seen in FIGS. 1-5, portable furniture item 100 defines a stool 102. In contrast, portable furniture item 200 depicted in FIG. 6 defines a table 202. A wide variety of portable furniture item types are contemplated and consistent with the concepts described below, including chairs, stools, benches, ottomans, tables, pedestals, desks, shelves, cases, cabinets, counters, bars, beds, sofas, recliners, examination tables, and the like.

The portable nature of the furniture described herein is especially well suited for use in events, such as trade shows, concerts, receptions, presentations, and the like. The portable furniture described herein is also well suited for emergency response situations because the furniture may be readily transported to a remote location by emergency personnel, such as health care workers, in a stowed configuration and deployed as needed. There are military and law enforcement field applications for the portable furniture as well.

Stool 102 functions to support a user in a seated and/or a partially standing position. The height of the stool can be selected to conform to a desired support position, such as a fully seated position in which the user's legs are more bent or a partially seated or leaning position where the user's legs are more upright. Different heights for stools of the same basic design can be selected to provide taller and shorter users with stools appropriate for their particular height, such as small, medium, and tall stools.

Figure 3:
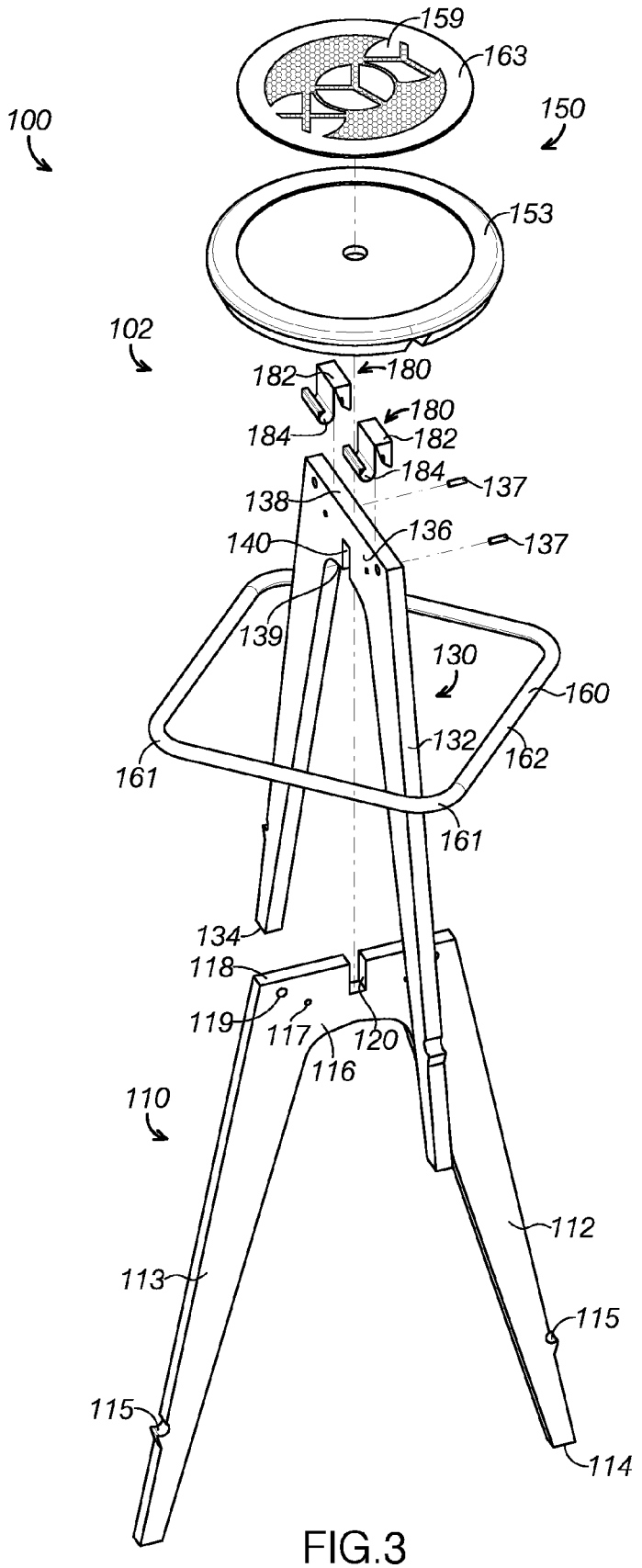
FIG. 3 is an exploded, perspective view of the portable furniture item shown in FIG. 1.

With reference to FIG. 3, the reader can see that stool 102 is configured to conveniently assemble from a relatively small number of components and to conveniently disassemble as needed. Transporting and storing stool 102 is convenient and efficient because stool 102 disassembles readily and can be readily placed into a stowed configuration. The reader can see in FIG. 4 that stool 102 is configured to adopt a stowed configuration in which the components of stool 102 are compactly and elegantly arranged. In some examples, a bag or case is provided to receive and protect the components of the stool when the stool is disassembled and transported.

Figure 6:
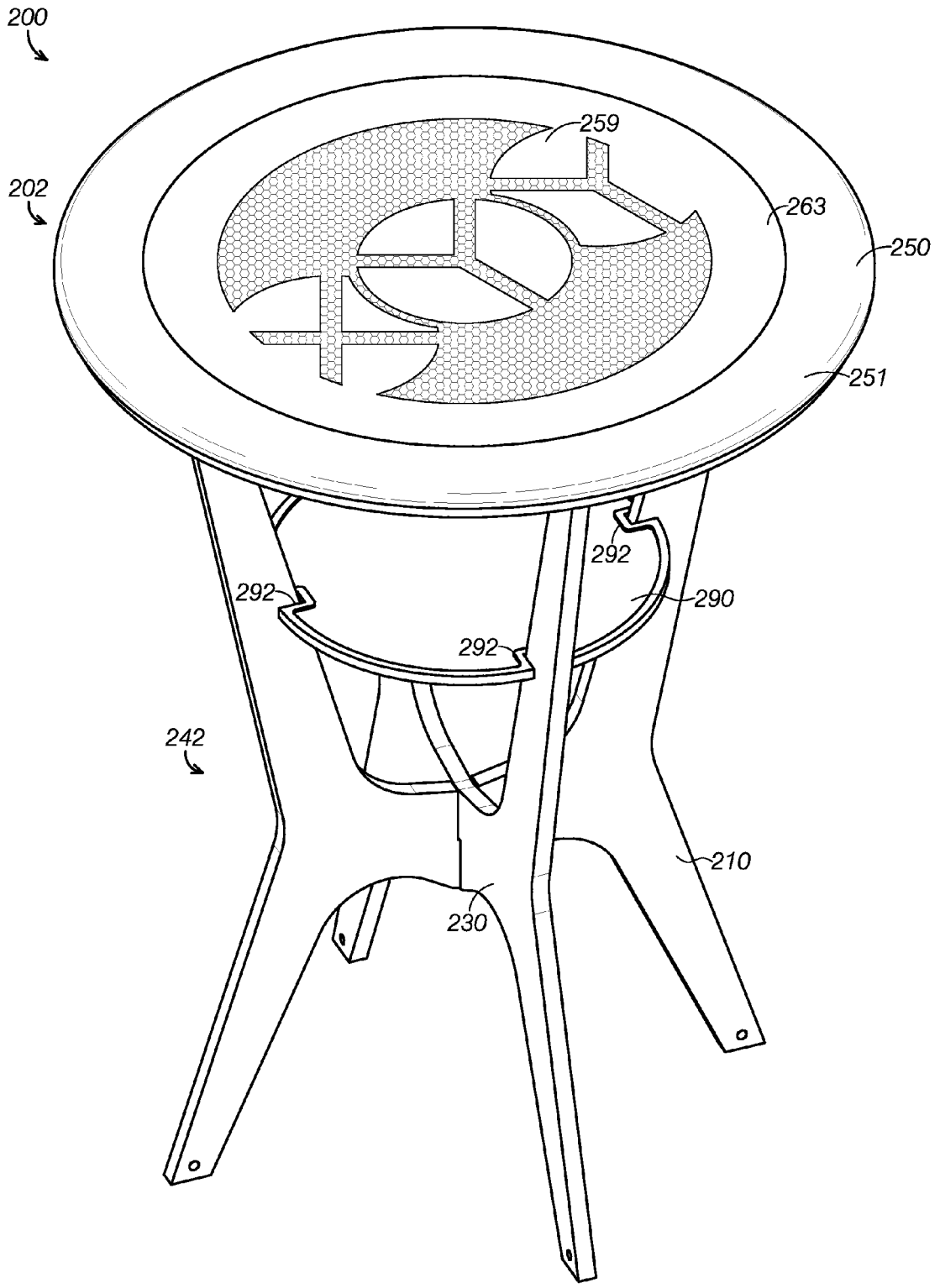
FIG. 6 is a perspective view of a second example of a portable furniture item in the form of a table.

As shown in FIGS. 1 and 6, stool 102 and table 202 are aesthetically pleasing as well as functional. Portable furniture incorporating the features discussed herein are especially well suited for hosted events because they are portable, easy to store, easy to assemble and disassemble, and aesthetically pleasing.

Figure 4:
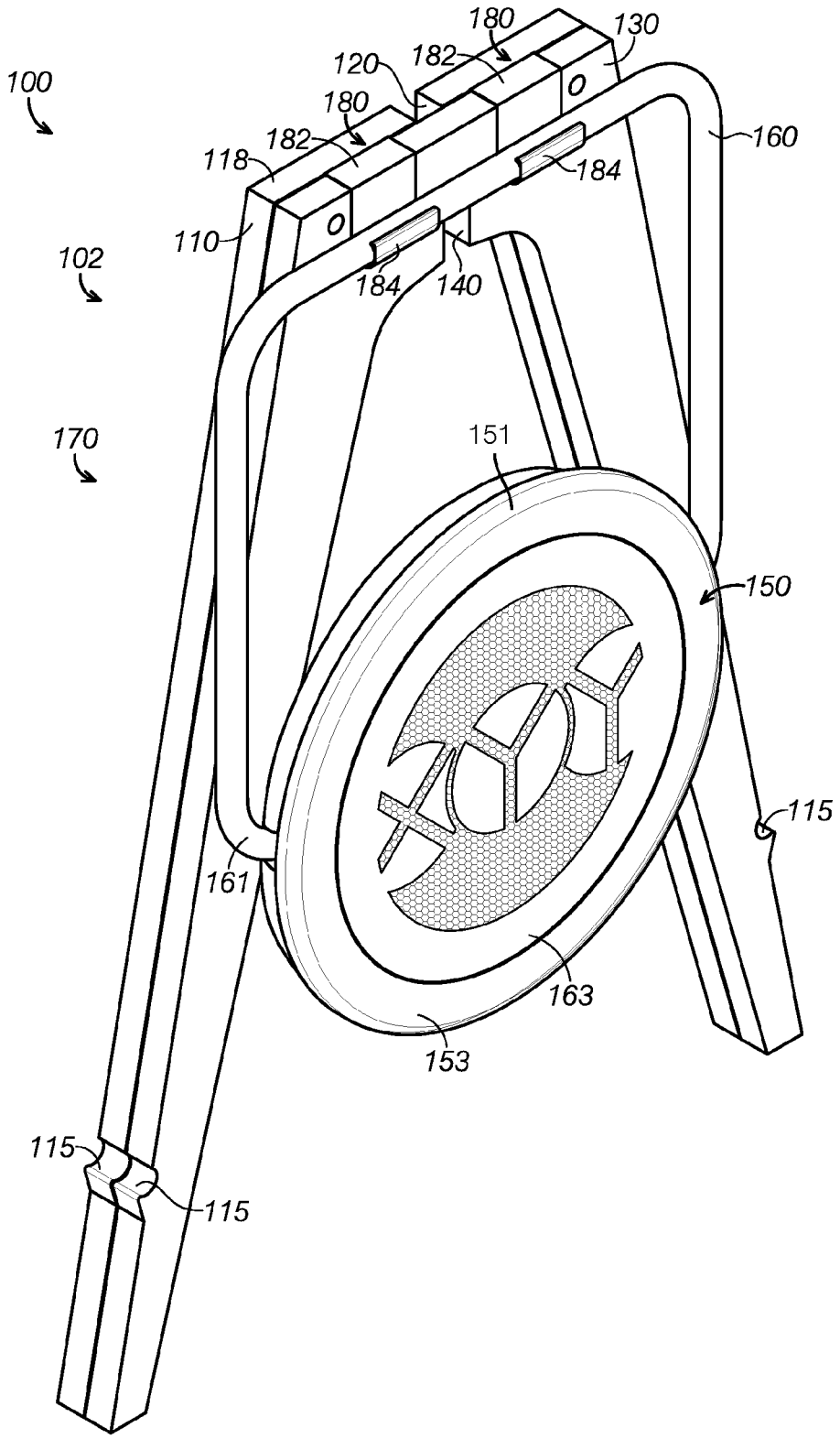
FIG. 4 is a perspective view of the portable furniture item shown in FIG. 1 in a stowed configuration.

In addition to functioning as a seat, stool 102 serves as an advertising platform. As shown in FIGS. 1, 3, and 4, stool 102 includes a logo 159 on a removable inlay 163 of a top member 150. Further details regarding top member 150, removable inlay 163, and logo 159 are provided below.

As shown in FIGS. 1-5, stool 102 includes a first support 110, a second support 130, a rigid member 160, a top member 150, and a hanger 180. Rigid member 160 and hanger 180 are optional features not present in all examples of the stools and other portable furniture items discussed herein. In the present example, stool 102 includes two hangers while other examples include a single hanger or more than two hangers.

With reference to FIGS. 1-4, the reader can see that first support 110 includes a first leg 112, a second leg 113, and a waist 116. In the present example, first support 110 is made from wood. In other examples, the first support is made from other suitable materials, including metal, plastic, composites, and combinations thereof.

First leg 112 has a ground end 114 configured to contact the ground and waist 116 extends from leg 112 opposite ground end 114. Second leg 113 is laterally spaced from first leg 112. As shown in FIGS. 1-4, first leg 112, waist 116, and second leg 113 collectively define an arched member.

Figure 2:
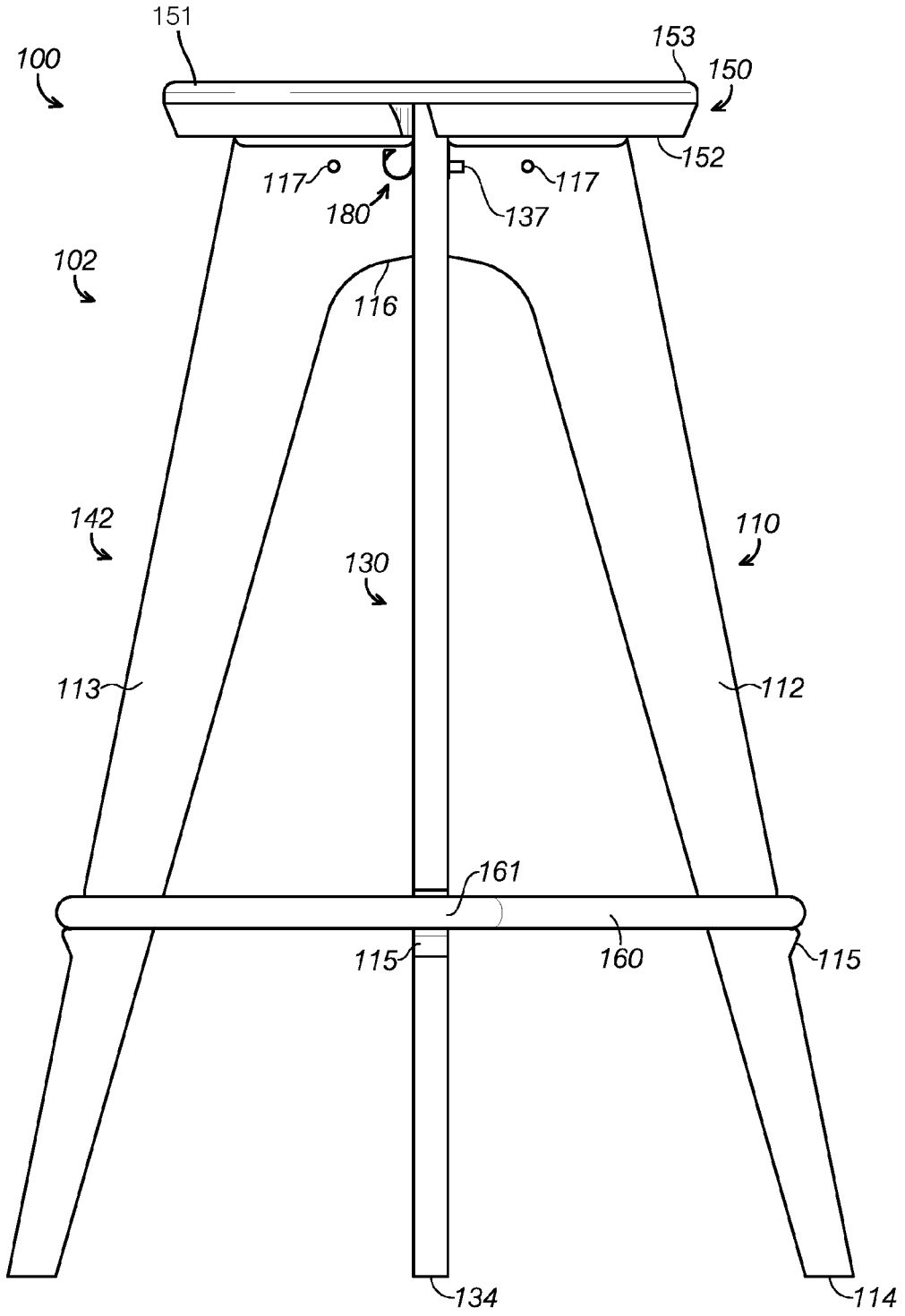
FIG. 2 is a front elevation view of the portable furniture item shown in FIG. 1.

As shown in FIGS. 3 and 4, first leg 112 of first support 110 defines lateral notches 115. As shown in FIGS. 1 and 2, lateral notches 115 are complimentarily configured with rigid member 160 to receive and support rigid member 160. Second leg 113 and second support 130 also defines lateral notches complimentarily configured with rigid member 160 to receive and support rigid member 160.

As can be seen in FIG. 3, waist 116 has an upper end 118 opposite ground end 114. Waist 116 defines a first notch 120 and a recess 117 proximate upper end 118. Waist 116 further defines a detent recess 119 proximate upper end 118.

Second support 130 is similar in many respects to first support 110. Referring to FIGS. 1-4, the reader can see that second support 130 includes a leg 132 and waist 136. Leg 132 has a ground end 134 configured to contact the ground and waist 136 extends from leg 132 opposite ground end 134. As shown in FIG. 3, waist 136 has an upper end 138 opposite ground end 134 and a lower end 139 opposite upper end 138. As seen in FIG. 3, a second notch 140 is defined by waist 136 proximate lower end 139.

While second support 130 is similar in many respects to first support 110, second notch 140 is in a different, complimentary position on second support 130 than the position of first notch 120 on first support 110. The arrangement of first notch 120 on first support 110 relative to second notch 140 on second support 130 enables the notches to matingly engage as depicted in FIG. 3. As shown in FIG. 3, first notch 120 is configured to receive second support 130. In particular, first notch 120 is complimentarily configured with second notch 140 to matingly couple with second notch 140. When second support 130 is received in first notch 120 and first support 110 is received in second notch 140, the supports collectively define a support structure 142.

As can be seen in FIGS. 1-4, first support 110 and second support 130 have substantially similar profiles. The similar profiles between first support 110 and second support 130 make manufacturing more effective and they enable stool 102 to adopt a compact, efficient stowed configuration 170 as shown in FIG. 4. In stowed configuration 170, first support 110 and second support 130 overlie one another to share a common profile. To help orient first support 110 to overlie second support 130 and to selectively couple the supports together in stowed configuration 170, waist 136 of second support 130 includes a post 137 configured to insert into recess 117 of first support 110.

As shown in FIGS. 1-3, rigid member 160 is configured to extend laterally around support structure 142 and rest within lateral notches 115. As can be seen in FIGS. 1-3, rigid member 160 is substantially square with rounded corners 161. In other examples, the rigid member is a shape other than square, such as circular, triangular, rectangular, pentagonal, hexagonal, etc., or irregular.

In the configuration depicted in the figures, rigid member 160 is tubular and made of aluminum. In other examples, the rigid member is solid rather than tubular and made from different materials, such as different metals, wood, plastics, composites, and combinations thereof. In some examples, such as with portable furniture item 200 depicted in FIG. 6, the portable furniture item does not include a rigid member.

In the present example, rigid member 160 defines a footrest 162. Lateral notches 115 are defined in the legs of support structure 142 at a height above the ground selected to position footrest 162 at a position proximate a user's foot when the user is sitting on top member 150 coupled to support structure 142.

With reference to FIGS. 1-5, the reader can see that top member 150 is configured to selectively couple to support structure 142 and defines a seat 151. In the example shown in FIG. 6, top member 250 defines a tabletop 251 instead of a seat. As shown in FIGS. 1-5, top member 150 includes a circumferential lip 153, a removable inlay 163, a bottom face 152, and detent members 158.

The size and shape of the top member may be anything suitable for the function of the top member. In examples where the top member defines a seat, the top member may be smaller or larger (such as to define a bench seat) than the proportionate size depicted in FIGS. 1-5. In examples where the top member defines a tabletop, the top member may be larger or smaller as well. The shape of the top member may be any suitable shape, such as circular, oval, square, rectangular, triangular, other regular geometric shapes, or irregular geometric shapes. Any currently known or later developed material or combination of materials may be used to form the top member.

Removable inlay 163 is surrounded and laterally supported by circumferential lip 153. In the present example, removable inlay 163 and circumferential lip 153 are circular, but they are other shapes in other examples. In some examples, the top member does not include a removable inlay, but instead is a solid member.

In the present example, removable inlay 163 depicts a logo 159 displaying a brand identifier. In some examples, the removable inlay includes a company name, an advertising slogan, a design, indicia, a bar code, or a QR-code. In some examples, the top member does not include an inlay, but instead is a single piece with a logo, design, or indicia displayed on it.

Figure 5:
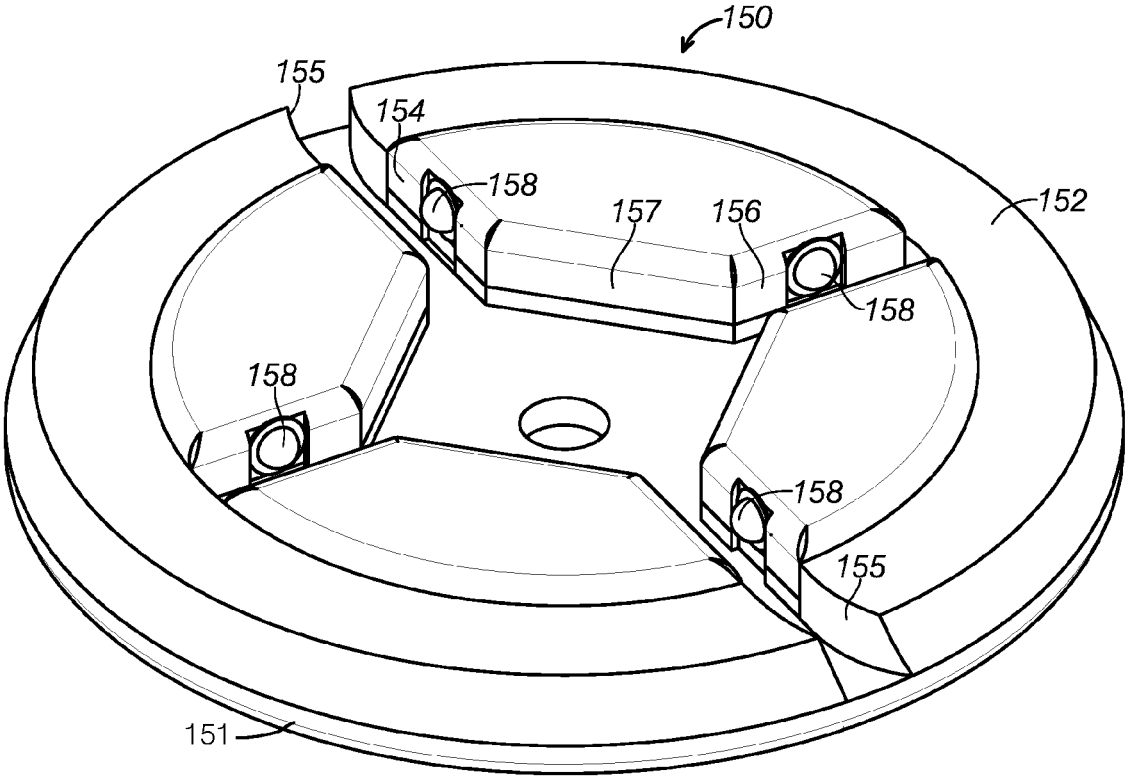
FIG. 5 is a perspective view of the underside of a top member of the portable furniture item shown in FIG. 1 depicting detent members extending from recesses formed in the underside of the top member.

As can be seen in FIG. 5, bottom face 152 faces support structure 142 when top member 150 is selectively coupled to support structure 142. With continued reference to FIG. 5, the reader can see that top member 150 defines a first recess 154 extending across bottom face 152, a second recess 156 extending across bottom face 152, and a central recess 157. In the present example, the first and second recesses are transversely aligned and cross at central recess 157, but they may be oriented in any suitable orientation complimenting the orientation of the first and second supports.

By reviewing FIGS. 3 and 5 in combination, the reader can see that first recess 154 and second recess 156 are complimentarily configured with upper ends 118 and 138 of first waist 116 and secnd waist 136, respectively. The complimentary configuration of the recesses and the upper ends allows first and second recesses 154 and 156 to receive upper ends 118 and 138, respectively, when top member 150 is selectively coupled to support structure 142.

To assist with top member 150 selectively coupling with support structure 142, top member 150 includes detent members 158 disposed in first recess 154 and in second recess 156. Detent members 158 are complimentarily configured with detent recesses 119 and insert into detent recesses 119 when top member 150 selectively couples with support structure 142. Detent recesses 119 and detent members 158 cooperate to secure top member 150 to support structure 142 until a user elects to disassemble stool 102. When a user wishes to disassemble stool 102, he may pull upward on top member 150 and disengage detent members 158 from detent recesses 119.

As shown in FIG. 5, first recess 154 includes curved portions 155. First recess 154 is complimentarily configured with rigid member 160 and curved portions 155 compliment rounded corners 161 of rigid member 160. As shown in FIG. 4, rigid member 160 may be inserted into first recess 154 and support top member 150 in a position where rigid member 160 and top member 150 lie in substantially same plane. The reader can see in FIG. 4 that the complimentary configuration between first recess 154 and rigid member 160 enables these components to adopt a space-saving arrangement in stowed configuration 170.

As shown in FIG. 4, hangers 180 support rigid member 160 and top member 150 in stowed configuration 170. Each hanger 180 includes a first hook member 182 and a second hook member 184. First hook member 182 is complimentarily configured with upper end 138 of second support 130 to selectively receive upper end 138 and thereby selectively couple with second support 130.

Second hook member 184 is integrally coupled to first hook member 182. In other examples, the second hook member is non-integrally coupled to the first hook member and instead couples by mechanical means. As shown in FIG. 4, second hook member 184 is complimentarily configured with rigid member 160 to receive and support rigid member 160. Rigid member 160 hangs down from second hook member 184 and top member 150 is supported by rigid member 160 received in first recess 154 of top member 150.

Turning attention to FIG. 6, a second example of a portable furniture item, portable furniture item 200, will now be described. Portable furniture item 200 includes many similar or identical features to portable furniture item 100. Thus, for the sake of brevity, each feature of portable furniture item 200 will not be redundantly explained. Rather, key distinctions between portable furniture item 200 and portable furniture item 100 will be described in detail and the reader should reference the discussion above for features substantially similar between the two furniture items.

The main distinguishing characteristic between furniture item 200 and furniture item 100 is that furniture item 200 defines a table 202 as compared to a stool. Table 202 is configured for quick and easy assembly and disassembly as well as for being convenient to transport between locations. As can be seen in FIG. 6, table 202 is aesthetically pleasing and can serve as an advertising platform with custom logos, indicia, and the like being displayed.

As shown in FIG. 6, furniture item 200 includes a first support 210, a second support 230, a top member 250, and a tray 290. First support 210 and second support 230 matingly engage to define a support structure 242. Top member 250 defines a tabletop 251 with a removable inlay 263 displaying a logo 259. Removable inlay 263 can be interchanged with other inlays having different logos and the like printed thereon.

Tray 290 is supported between first support 210 and second support 230 of support structure 242. Tray 290 is an optional feature and some examples of the table do not include a tray. In the present example, tray 290 defines a plurality of tray notches 292. Tray notches 292 are complimentarily configured with first support 210 and second support 230 to receive first support 210 and second support 230 when tray 290 mounts to support structure 242.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A portable furniture item, comprising:

a first support including:

a first leg having a first ground end configured to contact the ground and a first top end opposite the first ground end; and a first waist at the first top end extending from the first leg opposite the first ground end, the first waist having a first upper end opposite the first ground end and defining a first notch proximate the first upper end;

a second support including:

a second leg having a second ground end configured to contact the ground and a second top end opposite the second ground end; and a second waist at the second top end extending from the second leg opposite the second ground end, the second waist having a second upper end opposite the second ground end and a lower end opposite the second upper end, the second waist of the second support defining a second notch proximate the lower end;

wherein the first notch and the second notch are complimentarily configured to enable the second support to matingly couple with the first support to define a support structure, the support structure having the second support received in the first notch and the first support received in the second notch; and a top member selectively coupled to the support structure wherein:

the second waist includes a post;

the first waist defines a first waist recess complimentarily configured with the post to receive the post;

the first support and the second support have substantially similar profiles; and the first support and the second support are substantially aligned to share a common profile and collectively define a stowed configuration when the post is inserted into the first waist recess.

2. The portable furniture item of claim 1, further comprising a rigid member extending laterally around the support structure.

3. The portable furniture item of claim 2, wherein the rigid member is spaced from the first and second ground ends, defines a footrest, and extends around the support structure at a height above the ground selected to correspond to the position of a user's foot when the user is sitting on the top member coupled to the support structure.

4. The portable furniture item of claim 2, wherein the first support defines a lateral notch complimentarily configured with the rigid member to receive and support the rigid member.

5. The portable furniture item of claim 2, further comprising a hanger having:

a first hook member complimentarily configured with the second upper end of the second support to selectively receive the second upper end of the second support to selectively couple with the second support; and a second hook member coupled to the first hook member and complimentarily configured with the rigid member to receive and support the rigid member.

6. The portable furniture item of claim 1, wherein the first support includes a second leg laterally spaced from the first leg.

7. The portable furniture item of claim 1, wherein:

the top member includes a bottom face facing the support structure when the top member is selectively coupled to the support structure;

the top member defines a first recess extending across the bottom face and a second recess extending across the bottom face, the first recess and the second recess being complimentarily configured with the first and second upper ends of the first and second waists of the first and second support members, respectively, to receive the first and second upper ends when the top member is selectively coupled to the support structure.

8. The portable furniture item of claim 7, wherein:

the top member includes a detent member disposed in the first recess;

the first waist of the first support defines a detent recess proximate the first upper end and complimentarily configured with the detent member to receive the detent member when the first upper end of the first support is inserted into the first recess.

9. The portable furniture item of claim 7, further comprising a rigid member configured to extend laterally around the support structure and configured to selectively couple with the top member when the top member is not selectively coupled to the support structure, the rigid member being substantially square with rounded corners; wherein the first recess includes curved portions and is complimentarily configured with the rigid member to receive the rigid member when the top member is selectively coupled to the rigid member by inserting the rigid member into the first recess, the curved portions of the first recess aligning with two of the rounded corners of the rigid member.

10. The portable furniture item of claim 9, wherein the rigid member and the top member lie in substantially the same plane when the rigid member is inserted into the first recess of the top member.

11. The portable furniture item of claim 1, wherein the top member defines a seat and the portable furniture item defines a stool.

12. The portable furniture item of claim 1, wherein the top member defines a tabletop and the portable furniture item defines a table.

13. The portable furniture item of claim 1, wherein the top member includes a circumferential lip and a removable inlay surrounded by the circumferential lip.

14. The portable furniture item of claim 13, wherein the removable inlay includes one or more of a design, logo, or indicia.

15. The portable furniture item of claim 1, further comprising a tray supported between the first support and the second support of the support structure.

16. A portable furniture item, comprising:

a first support including:

a first leg having a first ground end configured to contact the ground and a first top end opposite the first ground end; and a first waist at the first top end extending from the first leg opposite the first ground end, the first waist having a first upper end opposite the first ground end and defining a first notch proximate the first upper end;

a second support including:

a second leg having a second ground end configured to contact the ground and a second top end opposite the second ground end; and a second waist at the second top end extending from the second leg opposite the second ground end, the second waist having a second upper end opposite the second ground end and a lower end opposite the second upper end, the second waist of the second support defining a second notch proximate the lower end;

wherein the first notch and the second notch are complimentarily configured to enable the second support to matingly couple with the first support to define a support structure, the support structure having the second support received in the first notch and the first support received in the second notch; and a top member including a bottom face facing the support structure when the top member is selectively coupled to the support structure, the top member defining a first recess extending across the bottom face and a second recess extending across the bottom face, the first recess and the second recess being complimentarily configured with the first and second upper ends of the first and second waists of the first and second support members, respectively, to receive the first and second upper ends when the top member is selectively coupled to the support structure; and a rigid member configured to extend laterally around the support structure and configured to selectively couple with the top member when the top member is not selectively coupled to the support structure, the rigid member being substantially square with rounded corners;

wherein the first recess includes curved portions and is complimentarily configured with the rigid member to receive the rigid member when the top member is selectively coupled to the rigid member by inserting the rigid member into the first recess, the curved portions of the first recess aligning with two of the rounded corners of the rigid member.

17. The portable furniture item of claim 16, wherein the rigid member and the top member lie in substantially the same plane when the rigid member is inserted into the first recess of the top member.

18. The portable furniture item of claim 16, wherein, when the rigid member extends laterally around the support structure, the rigid member:

defines a footrest;

is spaced from the first and second ground ends; and extends around the support structure at a height above the ground selected to correspond to the position of a user's foot when the user is sitting on the top member coupled to the support structure.

19. The portable furniture item of claim 16, wherein the top member defines a seat and the portable furniture item defines a stool.

20. The portable furniture item of claim 16, wherein the top member defines a tabletop and the portable furniture item defines a table.

* * * * *